US008716937B1

(12) United States Patent
Mays, II

(10) Patent No.: US 8,716,937 B1
(45) Date of Patent: May 6, 2014

(54) LIGHTING BALLAST WITH REDUCED FILAMENT DRIVE AND PIN CURRENT BALANCING

(75) Inventor: Stephen D. Mays, II, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 262 days.

(21) Appl. No.: 13/235,792

(22) Filed: Sep. 19, 2011

(51) Int. Cl.
*H01J 13/32* (2006.01)

(52) U.S. Cl.
USPC ..... 315/106; 315/97

(58) Field of Classification Search
USPC ..... 315/94, 97, 99, 102, 106, 107, 315/112–119, 219
See application file for complete search history.

(56) References Cited

U.S. PATENT DOCUMENTS 4,935,669 A 6/1990 Nilssen
5,877,592 A * 3/1999 Hesterman et al. ..... 315/106
6,144,539 A 11/2000 Konopka et al.
6,281,641 B1 * 8/2001 Chen et al. ..... 315/307
6,320,329 B1 11/2001 Wacyk
6,664,742 B2 12/2003 Venkateraman et al.
7,372,213 B2 5/2008 Kuo et al.
7,586,268 B2 9/2009 Gawrys et al.
8,324,813 B1 * 12/2012 Xiong ..... 315/94

* cited by examiner

*Primary Examiner* — Tung X Le
(74) *Attorney, Agent, or Firm* — Waddey Patterson; Mark J. Patterson; Gary L. Montle

(57) ABSTRACT

A lighting ballast includes a filament drive reduction circuit with a first inductor coupled across a filament drive source, and a second inductor and a capacitor coupled in parallel to define an LC tank between a first end of the first inductor and the filament drive source. The inductance value of the second inductor and the capacitance value of the capacitor are selected such that the natural resonance of the LC tank is substantially equal to the normal operating frequency of the filament drive source, wherein the LC tank acts as an open circuit during normal operation and the first inductor acts to balance the pin currents of series connected lamp filaments. The first and second inductors are further substantially equal in value, wherein excess filament drive current is shunted away in accordance with a normal operating frequency.

11 Claims, 4 Drawing Sheets

LIGHTING BALLAST WITH REDUCED FILAMENT DRIVE AND PIN CURRENT BALANCING

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: None

BACKGROUND OF THE INVENTION

The present invention relates generally to lighting ballasts for powering fluorescent lamps. More particularly, the present invention relates to rapid start or programmed start ballasts configured to reduce filament drive and to simultaneously balance pin currents through series connected filaments of series connected lamps.

A conventional lighting ballast design is represented in FIG. 3 and is further described herein as exemplary of problems currently existing in the art. Depending on the specific orientation of the ballast output lead wires, the steady state current flowing through the pins leading to the cathodes can exceed established manufacturer limits and significantly shorten the useful life of T4 and T5 fluorescent lamps. Ballasts designed with filament drive, commonly referred to as rapid start ballasts or programmed start ballasts, drive a common mode arc current (I_arc) through the length of the tube that is delivered via two pins on each end of the lamp (e.g., R_lamp1_pin1, R_lamp1_pin2 on a first end of Lamp1), and drive a differential mode current through both pins of one end of a lamp to heat the filament.

Current phasing and general imbalance of resistive elements used as part of the driving filaments can cause instantaneous current amplitudes to add and thereby increase the pin current. Series-connected filaments are at the most risk due to using a wire strap WS from the pin of one lamp (e.g., Pin 4 of Lamp 1) to the pin of the other lamp (e.g., Pin 2 of Lamp 2), bypassing any elements otherwise available to control the pin current. In this case the current through one pin can be high, most likely the pin connected to the wire strap WS, and the current through the other pin will be low.

It would therefore be desirable to reduce the quantity of energy driven into the filaments, particularly series-connected filaments, and better balance the current through pins associated with series connected filaments.

There are numerous approaches conventionally known in the art to indirectly accomplish these tasks. The majority of these approaches merely reduce the filament drive current by either controlling a separate filament drive system or by resonance means. These approaches are adequate if rebuilding the inverter and ballast tank are an option, but this of course involves significant design effort and has substantial effect on the overall ballast design when added to an existing topology.

There are also known methods specifically chosen to directly shunt excess filament drive current and arc current without also further reducing filament drive current.

One method in particular (as represented for example in FIG. 4) has a single inductor across the filament load.

Depending on the operating frequency of the inverter and the value of the inductor and the filament drive capacitor, the filament drive can be amplified as a result of series resonance between the inductor and the filament drive capacitor. However, the amplification can dramatically increase the filament drive current, thereby increasing the pin current.

BRIEF SUMMARY OF THE INVENTION

A lighting ballast for powering fluorescent lamps and associated operating methods are herein provided in accordance with the present invention for simultaneously reducing the filament drive and balancing the pin currents of series-connected filaments in series-connected fluorescent lamps.

In one embodiment, a lighting ballast of the present invention includes an arc current drive source which is effective to drive an arc current through a plurality of lamps coupled to ballast output terminals. A filament drive source is further effective to drive a differential mode current through filaments at one end of each of a first lamp and a second lamp. A filament drive reduction circuit is provided which includes a first inductor coupled across the filament drive source, and a second inductor and a capacitor coupled in parallel with each other to define an LC tank between a first end of the first inductor and the filament drive source.

In an aspect of the present invention, the inductance value of the second inductor and the capacitance value of the capacitor are set such that the natural resonance of the LC tank is substantially equal to the normal operating frequency of the filament drive source, wherein the LC tank acts as a substantially open circuit during normal operation.

In another aspect, while the LC tank acts as a substantially open circuit the first inductor acts to balance the pin currents of series connected filaments associated with series connected lamps.

In another aspect, the inductance value of the first inductor is set to be substantially equal to the inductance value of the second inductor, wherein the filament drive reduction circuit shunts away excess filament drive current in accordance with a normal operating frequency of the filament drive source, which reduces the power dissipated by the filament in turn reducing the overall input power of the ballast.

DETAILED DESCRIPTION OF THE INVENTION

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices.

The term "circuit" means at least either a single component or a multiplicity of components, either active and/or passive, that are coupled together to provide a desired function.

Figure 1:
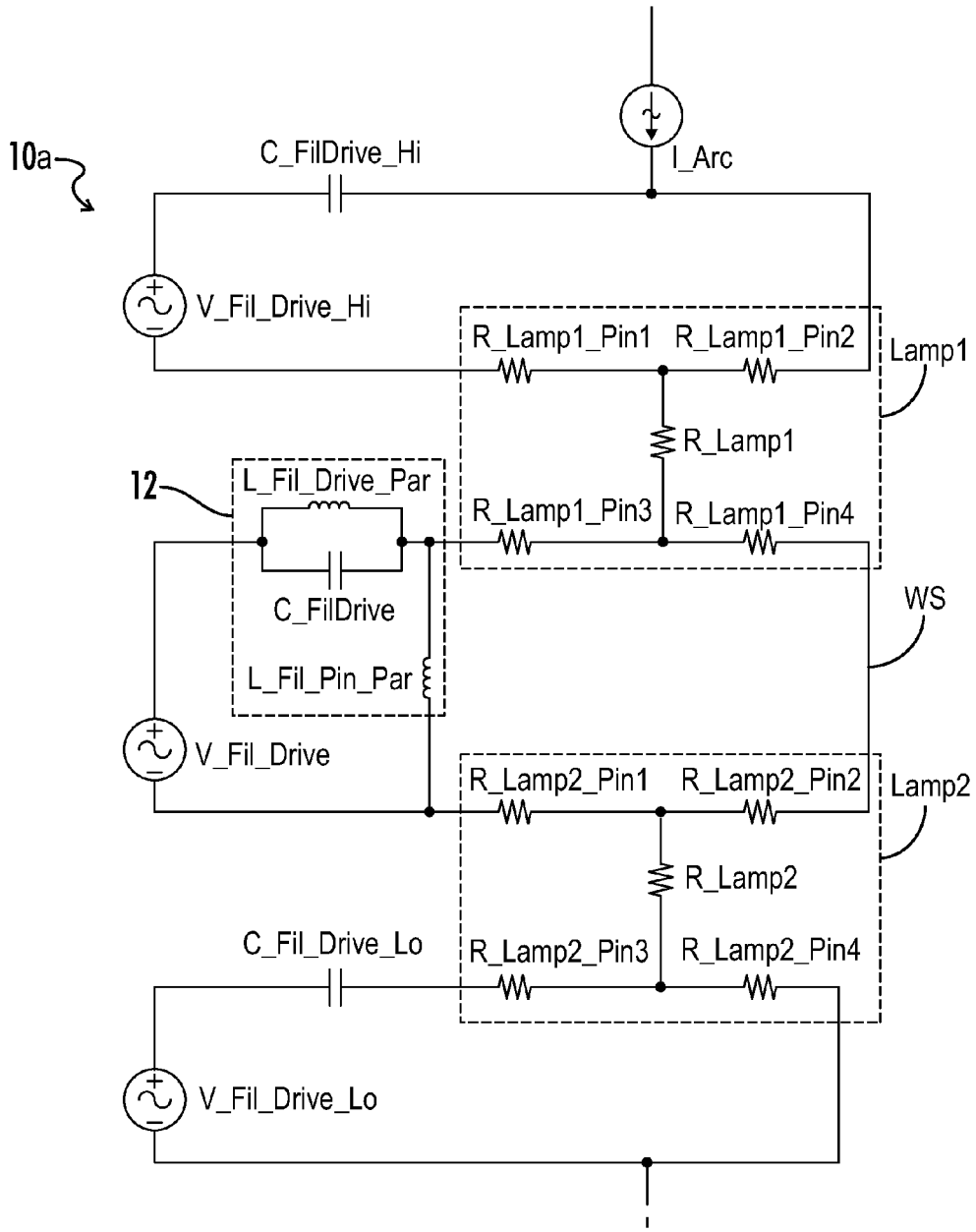
FIG. 1 is a circuit diagram representing an embodiment of a filament drive reduction circuit for a lighting ballast in accordance with the present invention.
Figure 2:
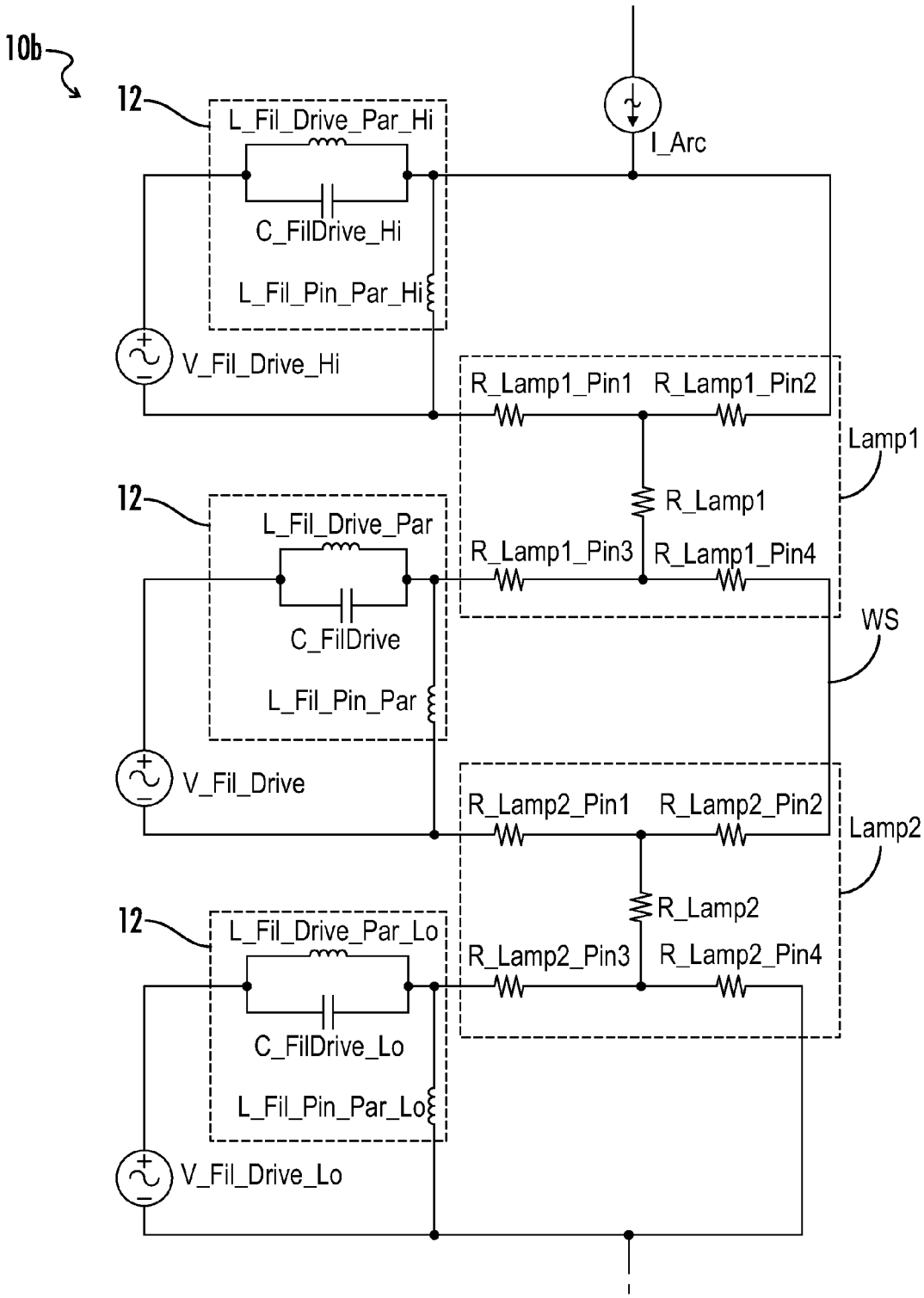
FIG. 2 is a circuit diagram representing another embodiment of a filament drive reduction circuit for a lighting ballast in accordance with the present invention.
Figure 3:
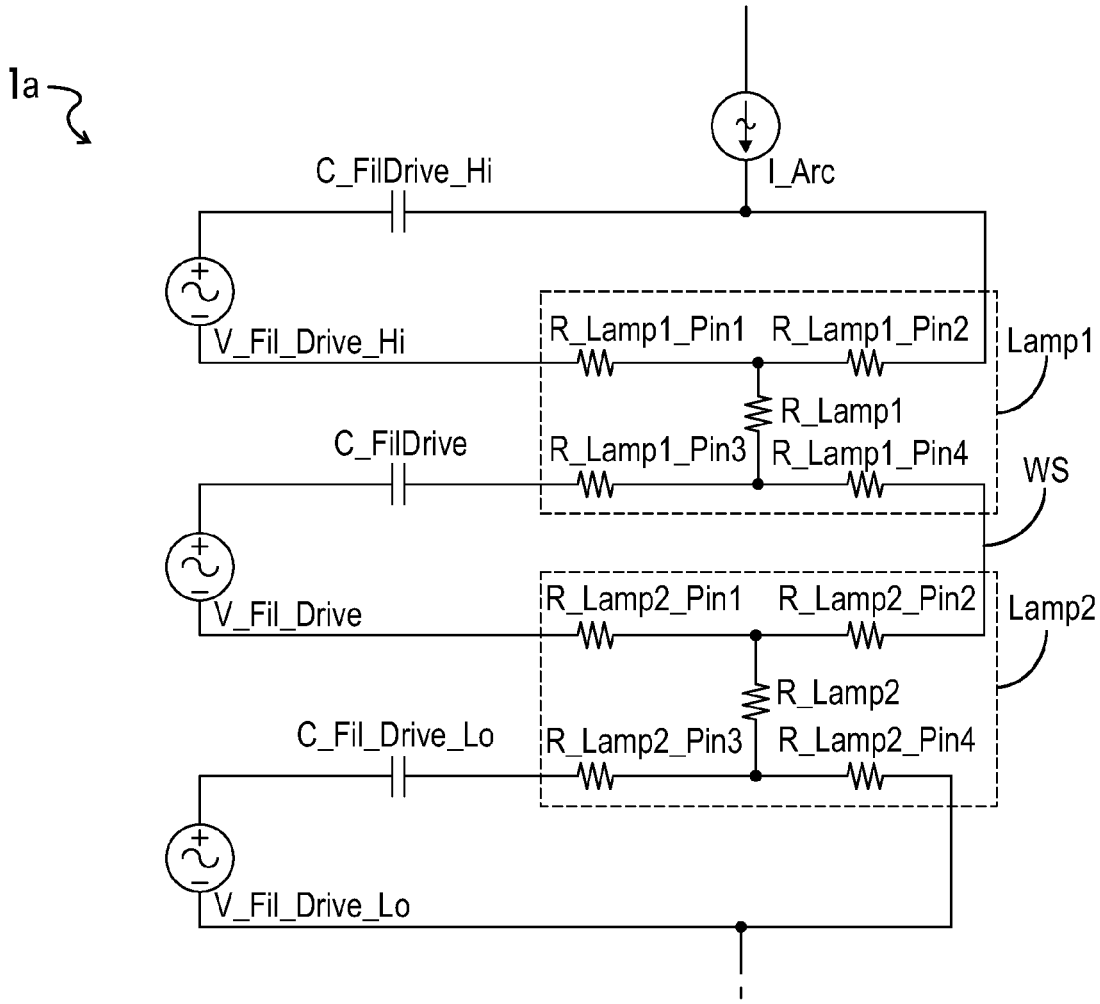
FIG. 3 (PRIOR ART)
FIG. 3 is a circuit diagram representing an output stage for a lighting ballast as conventionally known in the art.
Figure 4:
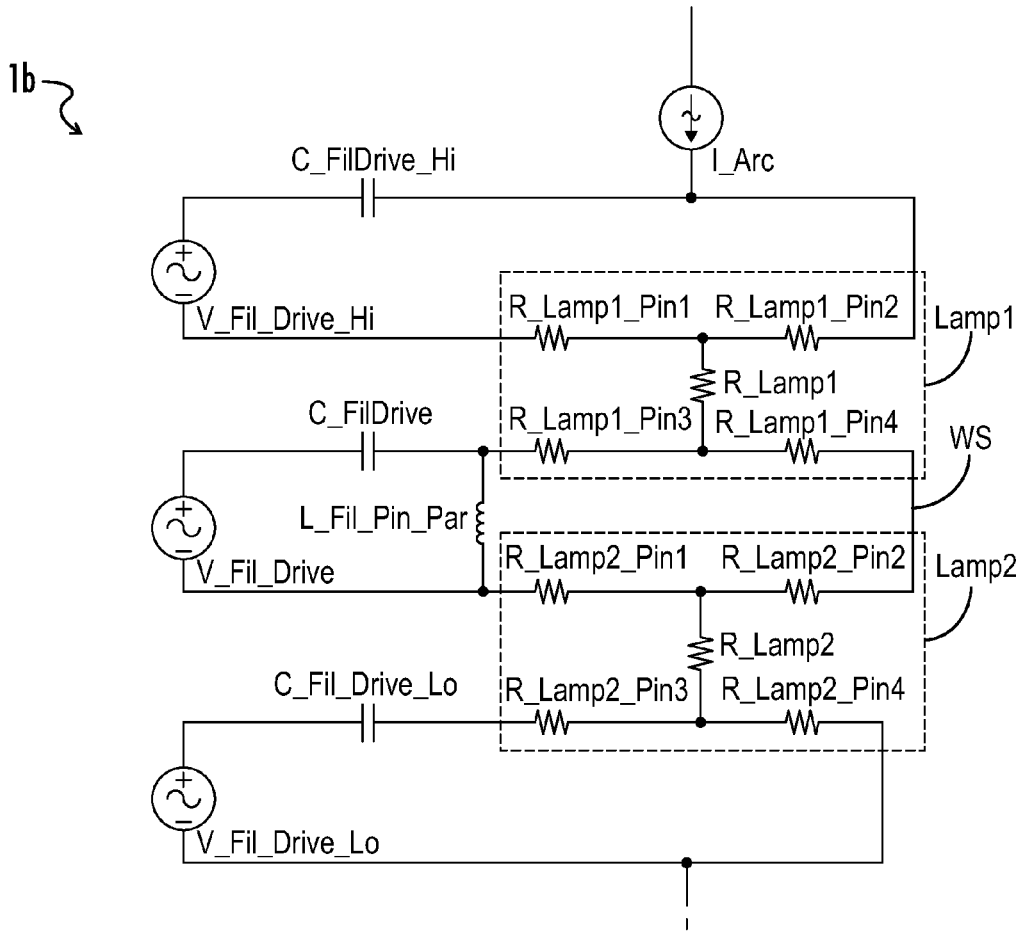
FIG. 4 (PRIOR ART)
FIG. 4 is a circuit diagram representing another example of an output stage for a lighting ballast as conventionally known in the art.

Referring generally to FIGS. 1 and 2, various embodiments of a programmed start ballast having a filament drive reduction circuit and associated operating methods in accordance with the present invention may be described further herein. Where the various figures may describe embodiments sharing various common elements and features with other embodiments, similar elements and features are given the same reference numerals and redundant description thereof may be omitted below.

Referring first to FIG. 1, a lighting ballast 10*a* in an embodiment of the present invention includes a common mode arc current source (not shown) effective to drive an arc current I_Arc through a plurality of lamps (e.g., Lamp1, Lamp2) coupled to output terminals of the ballast. A plurality of filament drive sources are further arranged to generate a filament drive current through filaments on either end of each of the plurality of lamps in a manner well known in the art. As represented in FIG. 1, a plurality of filament drive loops are defined, with a high side loop including filaments on a first end of Lamp 1, a low side loop including filaments on a second end of Lamp 2, and an intermediate loop which includes series-connected lamp filaments on a second end of Lamp 1 and a first end of Lamp 2. It may be understood that where more than two lamps are coupled in series (i.e., a plurality n), there may be a plurality of intermediate loops (n−1) having a configuration otherwise similar to that represented.

Generally stated, a filament drive reduction circuit 12 is provided for each of the one or more intermediate loops of the lighting ballast 10*a* and is effective to reduce the quantity of energy driven into the associated lamp filaments, and further to balance the current through both pins on either side of each filament during normal operation. For these purposes, the filament drive reduction circuit 12 in an embodiment as represented in FIG. 1 includes an LC tank with an inductor L_fil_drive_par coupled in parallel with a capacitor C_fil_drive, the LC tank being coupled in series with a filament drive source V_fil_drive, and a single inductor L_fil_pin_par placed in parallel with the filament load.

In typical rapid start or programmed start lighting ballasts, the pre-heat frequency is substantially higher than the normal operating frequency. In accordance with the present invention, the natural resonance of the LC tank may be set near the normal operating frequency of the inverter. In various embodiments, although not necessary, if the inductors L_fil_drive_par and L_fil_pin_par are set to have substantially the same value, the excess filament drive current will be shunted away by L_fil_drive_par during a pre-heat operating mode and the resulting pre-heat function will be maintained.

At a normal operating frequency, the LC tank is near resonance, which will be a high impedance state, and will operate substantially as an open circuit to block the differential mode filament drive current from the filament drive source.

The pin currents will in turn be substantially balanced between the pins at a second end of Lamp 1 and at a first end of Lamp 2 by flowing through the inductor L_fil_pin_par, which at the normal operating frequency has a lower impedance.

As represented in FIG. 1, the high-side and low-side sets of filaments (R_lamp1_pin1, R_lamp1_pin2 and R_lamp2_pin3, R_lamp2_pin4, respectively) may be driven by conventional circuitry given that the series-connected lamp filaments in the intermediate loops are at the most risk for reasons previously described.

However, referring now to FIG. 2, in an alternative embodiment of the lighting ballast 10*b* in accordance with the present invention, either or both of the high-side and low-side loops may also be provided with filament drive reduction circuits 12 as well. Operation of the filament drive reduction circuits 12 is substantially the same regardless of whether they are applied in high-side, low-side or intermediate filament drive loops.

The previous detailed description has been provided for the purposes of illustration and description. Thus, although there have been described particular embodiments of the present invention of a new and useful "Lighting Ballast with Reduced Filament Drive and Pin Current Balancing," it is not intended that such references be construed as limitations upon the scope of this invention except as set forth in the following claims.

What is claimed is:

1. A lighting ballast comprising:

an arc current drive source effective to drive an arc current through a plurality of lamps coupled to ballast output terminals;

a filament drive source effective to drive a differential mode current through filaments at one end of each of a first lamp and a second lamp;

a filament drive reduction circuit further comprising a first inductor coupled across the filament drive source, an LC tank further comprising a second inductor and a capacitor coupled in parallel with each other and between a first end of the first inductor and the filament drive source;

wherein the inductance value of the second inductor and the capacitance value of the capacitor are selected such that the resonance of the LC tank is substantially equal to the normal operating frequency of the filament drive source; and the inductance value of the first inductor is substantially equal to the inductance value of the second inductor.

2. The lighting ballast of claim 1, wherein the filament drive reduction circuit is functional to shunt away excess filament drive current in accordance with a normal operating frequency of the filament drive source.

3. The lighting ballast of claim 2, wherein the LC tank operates as a substantially open circuit in accordance with a normal operating frequency of the filament drive source.

4. A lighting ballast effective to power a plurality of lamps, the ballast comprising:

an arc current drive source effective to drive an arc current through the plurality of lamps;

one or more filament drive loops effective to receive series-connected lamp filaments, each of said filament drive loops further comprising a filament drive source effective to generate filament drive current at a pre-heat frequency and at a normal operating frequency, and a filament drive reduction circuit effective at the pre-heat frequency to shunt excess filament drive current through pins of series-connected lamp filaments, and further effective at the normal operating frequency to block the filament drive current through the pins of series-connected lamp filaments and to balance arc currents through the pins of the series-connected lamp filaments.

5. The lighting ballast of claim 4, the filament drive reduction circuit in each loop further comprising:

a first inductor coupled across the filament drive source; and an LC tank further comprising a second inductor and a capacitor coupled in parallel with each other and between a first end of the first inductor and the filament drive source.

6. The lighting ballast of claim 5, wherein the inductance value of the second inductor and the capacitance value of the capacitor are selected such that the resonance of the LC tank is substantially equal to the normal operating frequency of the filament drive source.

7. The lighting ballast of claim 6, wherein the inductance value of the first inductor is substantially equal to the inductance value of the second inductor.

8. A method of operating a lighting ballast including a filament drive reduction circuit to power a plurality of lamps coupled in series, the method comprising:

operating a filament drive source at a pre-heat frequency;

generating a filament drive current through pins of series-connected lamp filaments in response to the pre-heat frequency;

operating the filament drive source at a normal operating frequency;

blocking the filament drive current through the pins of series-connected lamp filaments in response to the open frequency;

driving a common mode arc current through the plurality of lamps; and balancing the pin currents associated with the series-connected lamp filaments.

9. The method of claim 8, the filament drive reduction circuit in each loop further comprising:

a first inductor coupled across the filament drive source, an LC tank further comprising a second inductor and a capacitor coupled in parallel with each other and between a first end of the first inductor and the filament drive source.

10. The method of claim 9, wherein the inductance value of the second inductor and the capacitance value of the capacitor are selected such that the resonance of the LC tank is substantially equal to the normal operating frequency of the filament drive source.

11. The method of claim 10, wherein the inductance value of the first inductor is substantially equal to the inductance value of the second inductor.

* * * * *